United States Patent [19]

Böttcher

[11] 4,091,606

[45] May 30, 1978

[54] OPEN END SPINNING FRAME WITH A MAGNETIC SWITCH FOR SLIVER FEED

[75] Inventor: Dieter Böttcher, Deggingen-Reichenbach, Germany

[73] Assignees: Fritz Stahlecker; Hans Stahlecker, both of Germany; 03 DT

[21] Appl. No.: 823,199

[22] Filed: Aug. 9, 1977

[30] Foreign Application Priority Data

Aug. 16, 1976 Germany ..... 2636845

[51] Int. Cl.[2] ..... D01H 1/12; D01H 13/16

[52] U.S. Cl. ..... 57/58.89; 57/81

[58] Field of Search ..... 57/34 R, 58.89, 58.95, 57/78, 80, 81, 83, 106, 22; 339/153

[56] References Cited

U.S. PATENT DOCUMENTS

| | | | |
|---|---|---|---|
| 3,370,800 | 2/1968 | Haberkern | 335/153 X |
| 3,676,990 | 7/1972 | Santerre et al. | 57/81 |
| 3,727,393 | 4/1973 | Mikulecky et al. | 57/58.89 X |
| 3,764,773 | 10/1973 | Merkle | 57/81 X |
| 3,782,089 | 1/1974 | Landwehrkamp | 57/58.95 X |
| 3,967,224 | 6/1976 | Seeley | 335/153 X |

*Primary Examiner*—Donald Watkins
*Attorney, Agent, or Firm*—Craig & Antonelli

[57] ABSTRACT

Open end spinning apparatus is provided which includes a magnetic reed switch for controlling sliver feed. A yarn sensor magnet attached to a movable yarn sensor engageable with a running yarn is disposed so as to open the magnetic switch and interrupt sliver feed upon occurrence of a yarn breakage. In order to prevent the need for moving the yarn after a piecing operation so as to properly engage the yarn sensor, an auxiliary magnet is provided which is movable into position to magnetically move the yarn sensor away from a blocking position in front of the yarn takeoff passage at a spinning unit. The auxiliary magnet is controlled by way of its position, and/or its magnetic field strength, so as to also selectively control the operation of the magnetic reed switch during piecing operations, while maintaining the sensor magnet, and yarn sensor out of a blocking position in front of the yarn takeoff passage.

9 Claims, 5 Drawing Figures

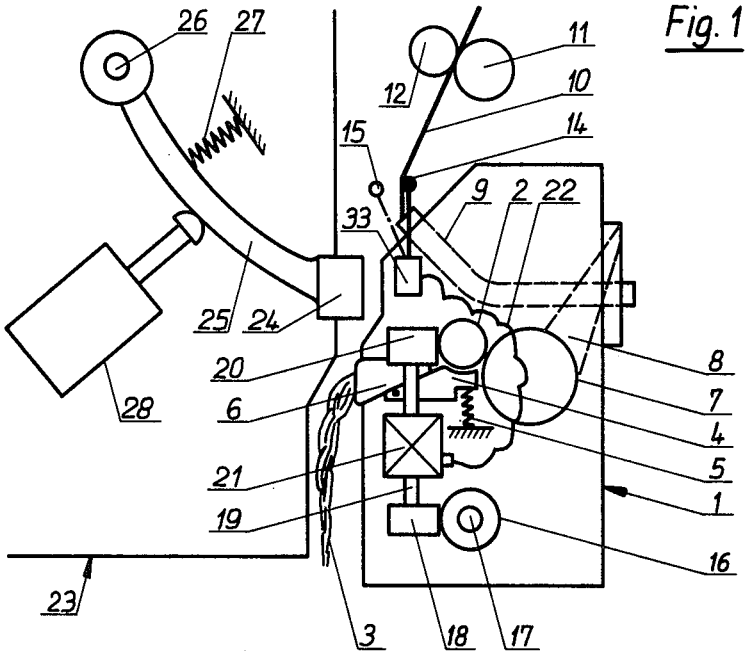
Fig. 1
Fig. 2
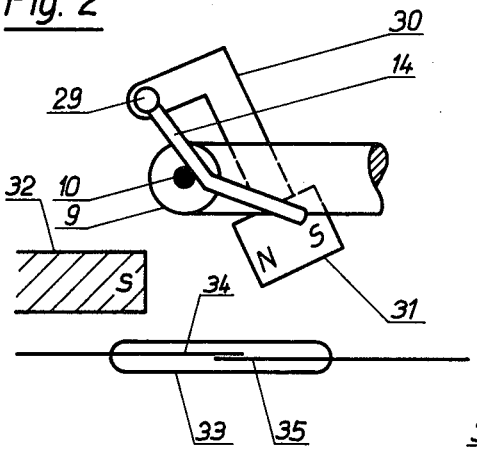
Fig. 3
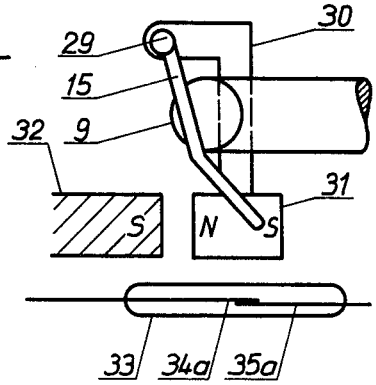

OPEN END SPINNING FRAME WITH A MAGNETIC SWITCH FOR SLIVER FEED

BACKGROUND AND SUMMARY OF THE INVENTION

The invention concerns an open end spinning frame with a plurality of spinning assemblies disposed side by side, which assemblies have a monitoring yarn sensor in the zone of the yarn takeoff passage that senses the presence of a yarn, said yarn sensor having a magnet, associated with which there is a stationary electromagnetic switch for switching on or off a device for sliver supply to the spinning assembly in question, in dependence upon the position of the yarn sensor, whereby an auxiliary magnet for switching on the sliver feed for a piecing process can be presented to the said magnetic switch.

In open end spinning assemblies it is customary to have arrangements whereby the sliver feed will be interrupted if there is a yarn break. For a piecing process, the sliver feed must again be switched on after a specific time interval, so that there will be a ring of sliver present in the spinning rotor to which yarn can be applied in piecing.

It is known (German AS No. 2,012,108) that a swingable yarn sensor may be provided for the spinning assemblies of an open end spinning frame, in the region of the yarn takeoff passage, said sensor having a magnet with which an electromagnetic switch is associated. With a break in the yarn, the yarn sensor swings into an inoperative position whereby its magnet moves away from the magnetic switch, opening the switch and interrupting the sliver feed. In this construction, a mobile device is provided for the open end spinning frame, from which the piecing operation is executed. The device has a transfer clamp disposed so as to be swingable by 180° about a vertical axis, which brings a yarn end over the opening of the yarn takeoff passage. For piecing, the yarn is then carried back into the spinning rotor, applied there to a ring of sliver and then drawn off again. In order to produce a sliver ring in the spinning rotor, there has to be correctly timed switching on of the sliver feed. In the known construction this is effected by means of an auxiliary magnet that replaces the magnetic field of the magnet connected with the yarn sensor in the region of the magnetic switch and switches on the sliver feed. In the known construction the yarn is introduced during the piecing in such a way that it lies on the wrong side of the yarn sensor, because the yarn sensor is still in its switched off position. After the piecing, the running yarn is deflected by means supplementary to the transfer clamp, in such a way that it is carried around the yarn sensor and moves to the correct side. Accordingly the yarn presses the sensor into its operative position, so that the yarn sensor magnet is opposite the magnetic switch and holds the sliver feed switched on until another yarn break occurs. The transfer of the running yarn to the other side of the yarn monitor requires expensive construction. Besides, the time spent by the piecing device at the spinning assembly in question is prolonged, which as a whole has a poor effect on the economy of the device.

The invention is addressed to the problem of producing an open end spinning frame of the indicated type in such a way that a yarn will be applied on the correct side of the yarn sensor in piecing, without thereby limiting the functioning efficiency of the piecing operation.

An important feature of the invention is the provision that the auxiliary magnet is disposed so that it may be moved to the magnet of the yarn sensor which is in the switched off position, the poles of the said magnets having the same polarity.

By this arrangement, the auxiliary magnet will exert a force on the yarn sensor magnet, whereby the yarn sensor will be brought into its operational position. In spite of this switchover of the yarn sensor, the sliver feed will not yet be switched on, because its control is then assumed by the auxiliary magnet, which is presented to the magnetic switch.

In an advantageous embodiment of the invention, it is provided that a stationary magnet with its poles disposed in opposition will be associated with the yarn sensor magnet, which stationary magnet draws the yarn sensor to the running yarn. The stationary magnet is thereby so disposed that yarn tension can then hold the yarn sensor against magnetic forces, in the position of operation. If there is a yarn break, the magnet of the yarn sensor will then be attracted to the stationary magnet, whereby then the forces acting between the two magnets will increase strongly as the distance is reduced.

In an advantageous embodiment of the invention, it is provided that the action of the auxiliary magnet presented to the yarn sensor magnet and to the magnetic switch can be varied according to its presentation. Here use is made of the situation that only minor magnetic forces are required to hold the yarn sensor magnet in the operating position because it is relatively remote from the magnet that is associated with it. The magnetic field of the auxiliary magnet can therefore be reduced in this position, without the yarn sensor thereby being moved out of its operating position. The reduction of the magnetic field may be such that thereby the magnetic switch will open and thus the sliver feed will be controlled. This allows the further advantage that during piecing the sliver feed can be simply controlled with respect to quantity, which is a special advantage in automatic piecing because thereby the quality and appearance of the pieced place can clearly be improved.

These and other objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a partial cross-sectional schematic view through an open end spinning assembly of an open end spinning frame along with a mobile servicing device, in accordance with the present invention;

FIG. 2 shows a detail of FIG. 1, on a larger scale;

FIG. 3 shows the detail of FIG. 2, in another operating position;

DETAILED DESCRIPTION OF THE DRAWINGS

Figure 4:
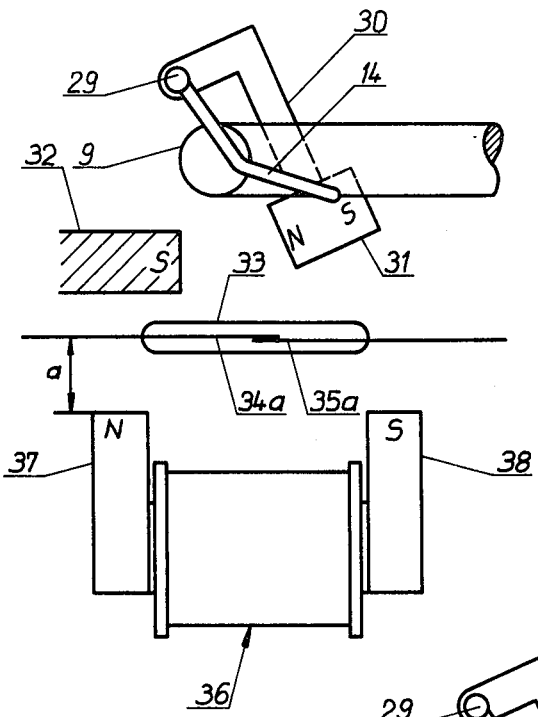
FIG. 4 shows details of FIGS. 1 and 2, after presentation of an auxiliary magnet.

In order not to obscure the invention, many details of the spinning machine, well known to those skilled in the art, are omitted from the drawings and the following description.

An open end spinning assembly 1, which is schematically shown in cross section in FIG. 1, has among other things a delivery roll 2 that supplies sliver 3 which is to be spun, to a fast running opening roll 7 which opens sliver 3 in a known way, to constitute individual filaments that are then taken to a spinning rotor (not illustrated), via a passage 8. Delivery roll 2 here acts together with a swingable delivery table 4, which is biased by a spring 5, forming a nip for sliver 3 which is presented via an intake hopper or funnel 6. Spun yarn 10 is taken out from a yarn drawoff passage 9 and transferred by takeoff rolls 11, 12 to a winding device, which is not illustrated.

In the zone of the opening of the yarn takeoff passage 9, there is a yarn sensor 14 which, as a consequence of the tension of yarn 10, is held in its operating state in a position indicated by solid lines, and swings out when there is a break in the yarn, to position 15 which is indicated by dot-and-dash lines. By the swinging out of yarn sensor 14 to position 15, a yarn monitoring switch 33 is actuated which in case of a break in the yarn, interrupts the feed of sliver 3. This interruption occurs by opening an electromagnetic coupling 21 which is electrically connected via a lead 22 with a yarn monitor switch 33 and is incorporated in the drive for the sliver feed. The drive for the feed roll 2 occurs via a worm gear 20 that is disposed on a standing shaft 19 and driven by another pair of worm gears 18, 16 driven by a shaft 17. As soon as yarn sensor 14 has swung out into its position 15, yarn monitor switch 33 switches electromagnetic couplings 21, whereby worm gear 20 stops and therewith the drive of feed roll 2 is interrupted.

In case of a yarn break, mobile servicing instrument 23 working as a piecing device is presented to spinning assembly 1, which instrument can present a working head 24 to yarn sensor 33. In this working head 24 there is an auxiliary magnet 36 (FIGS. 4 and 5) which will be described in more detail later on. Working head 24 is disposed on a lever 25 which is swingable in either direction about pin 26, and which is selectively presentable to yarn sensor 33 by an actuating element made as a stroke piston magnet 28, against the pressure of a spring 27.

FIG. 2 shows the zone of yarn sensor 14, as seen from above, in the operating state. Yarn sensor 14 is swingable about a shaft 29, and it is held by the tension of the drawn off yarn 10 in its operating position. Likewise swingable about pin 29, and connected with yarn sensor 14, to be fixed therewith in respect to rotation, is a bent pivot arm 30 which supports a magnet 31 at its free end. N and S are the two poles of magnet 31. At a greater distance on the other side of yarn 10, opposite pole N of magnet 31, there is an opposing S pole of a stationary magnet 32. Because of the relatively large distance between magnet 31 and stationary magnet 32, magnet 31 is attracted into its operating position with only a relatively small force from magnet 32, just enough in fact so that yarn sensor 14 will be applied in its operating position with slight tension against yarn 10. In the area of magnet 32 there is a "Reed contact", a magnetic switch disposed as yarn monitor switch 33, whose springing tongues 34, 35 of ferromagnetic material have no contact with each other, so long as yarn sensor 14 remains in its operating position, i.e. so long as no significant magnetic field lines run through tongues 34, 35.

FIG. 3 shows how the indicated relationships change in the instant in which a break in yarn 10 occurs and the yarn is no longer present. The action of magnets 32 and 31 has the effect that magnet 31 together with the yarn sensor are swung about pin 29 and transferred to the position shown in FIG. 3. Yarn sensor 14 now assumes inoperative position 15. In this position magnet 31 of yarn sensor 14 acts on the Reed contact magnetic switch 33, whose tongues now close and thereby assume the position **34*a*, 35*a*. This closing of magnetic switch 33 is transmitted via electric lead 22 of FIG. 1 to the electromagnetic coupling 21, whereby the drive of delivery roll 2 is stopped. We see also in FIG. 3 that the yarn sensor 14 in its inoperative position 15 makes it impossible to introduce a yarn at that time, past it into yarn takeoff passage 9 to which it ought to go in the operating state. Since every yarn sensor 14 must undergo a certain deflection when there is a yarn break, insofar as it is disposed in the area of the opening of yarn takeoff passage 9**, a threading-in process is thus obstructed.

To avoid the above-noted difficulty, an auxiliary magnet 36 is provided which can be presented to switch 33 for a piecing operation (FIG. 4). This auxiliary magnet 36 is, as already mentioned, disposed in working head 24 of the mobile piecing device 23. However it could be presented to switch 33 in other ways according to other now illustrated embodiments. Auxiliary magnet 36 has two magnetic poles 37, 38. Poles 37, 38 of auxiliary magnet 36 are so selected that they are opposite poles of the same polarity in control magnet 31 (i.e. the south pole of magnets 31 and 36 are on the right as viewed in the drawings, the north pole on the left). Auxiliary magnet 36 is substantially stronger than the previously mentioned stationary magnet 32, so that it exerts a repelling force on magnet 31 which is greater than the attracting force of magnet 32. Since the lines of the repelling forces on magnet 31 pass on axis 29 at an adequate distance, because of the bent configuration of lever 30, magnet 31 is swung into the position which it and yarn sensor 14 assume when yarn 10 is passing (of FIG. 2). In this position the opening of yarn takeoff passage 9 becomes free so that without additional mechanical means a yarn that is to be pieced can be introduced on the correct side of yarn sensor 14 into takeoff passage 9. So long as the introduced yarn is not yet pieced, it is necessary to keep the feed of sliver 3 interrupted. This means that the contacts of magnetic switch 33 must remain in their closed position **34*a*, 35*a*. This is managed in that auxiliary magnet 36 also acts on magnetic switch 33 and holds the contacts 34*a*, 35*a*. The relatively strong auxiliary magnet 36 thereby acts with its poles 37, 38 that are of the same polarity as those of magnet 31 so that even after swinging away of yarn sensor 14 with its magnet 31, switch 33 will remain closed so that feed for sliver 3** will continue to be switched off.

Figure 5:
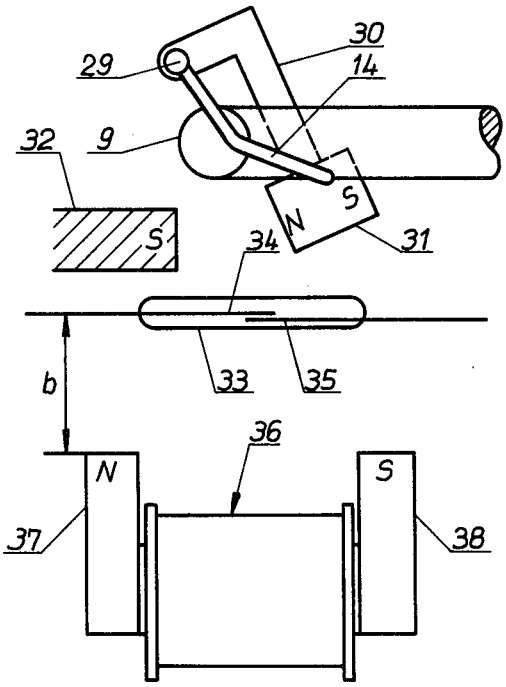
FIG. 5 shows the detail of FIG. 4 with changed action of the auxiliary magnet.

To produce a good piecing, it is necessary to undertake a slight preparatory feed into the spinning rotor before the actual piecing. Thus at a certain point in time, magnetic switch 33 must allow sliver feed, even before a yarn is pulled from yarn takeoff passage 9. FIG. 5 shows that by an enlargement of the distance *b* with respect to distance *a* of FIG. 4, there is the effect that the magnetic field of auxiliary magnet 36 will exert less force on magnetic switch 33, so that contacts 34, 35 will open. The same effect could of course also be attained if distance *a* (FIG. 4) were to remain unchanged and only the magnetic field of auxiliary magnet 36 were reduced, by reduction of its excitation (magnet 36 being an electromagnet in the preferred illustrated embodiment).

Since in this state magnet 31 is at a relatively great distance from stationary magnet 32, the repelling force on auxiliary magnet 36 is also reduced by the increased distance, enough to hold the yarn sensor in its operating position. As soon as the preliminary feed has been completed, auxiliary magnet 36 can again be restored to the position of FIG. 4 whereby the sliver feed will again be interrupted. It is also possible in the same way to bring auxiliary magnet 36 alternatingly into the positions of FIG. 4 and 5 respectively, whereby the drive of arm 25 will be switched correspondingly, with production of an alternating on and off switching of the feed and hence a control of the quantity of filaments supplied. As already mentioned, it is also contemplated, instead of changing the distance between *a* and *b*, to produce the same effect by variation of the strength of the magnetic field of auxiliary magnet 36.

In comparison with the indicated known arrangement, with the arrangement of the invention, it is not necessary to bring the pieced yarn supplementarily to the other side of yarn sensor 14. The mechanical devices required for this thereby become superfluous. Moreover, auxiliary magnet 36 which can be presented to magnetic switch 33 has a plurality of functions, namely on the one hand control of the switching on of the feed for sliver 3 and on the other hand the swinging of yarn sensor from its inoperative position 15 into its operating position 14. It is necessary to select the strength of the individual magnetic fields correctly, and of course the magnetic field of auxiliary magnet 36 must be greater in any case than the magnetic field of magnet 32. The magnetic field of auxiliary magnet 36 must also be stable, in the first working position shown in FIG. 4 to act in the same way on magnetic switch 33 as magnet 31 of yarn sensor 14 in its inoperative position. It must be so designed on the other hand that in a second working position it will no longer close magnetic switch 33 but hold magnet 31 in its position at a distance from magnet 32.

While I have shown and described a single embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Spinning machine apparatus comprising:

a yarn sensor disposed in the region of a yarn takeoff passage of an open-end spinning unit or the like, an electric magnetic switch operatively disposed in an electric circuit to control the switching on and off of a device for feeding sliver to the spinning unit, a sensor magnet connected with said yarn sensor for controlling said magnetic switch in dependence on the position of the yarn sensor, and an auxiliary magnet, separate from said sensor magnet, for switching on said magnetic switch to effect a supply of sliver for a piecing process at said spinning unit, said auxiliary magnet including poles which face poles of like polarity of said sensor magnet when said sensor is in a switched off position.

2. Spinning machine apparatus according to claim 1, wherein a plurality of open-end spinning units are provided, and wherein each of said spinning units includes one of said yarn sensors with associated sensor magnet, as well as one of said magnetic switches.

3. Spinning machine apparatus according to claim 1, further comprising an oppositely poled stationary magnet associated with the sensor magnet, said stationary magnet attracting the yarn sensor in a direction against running yarn coming from the yarn takeoff passage during spinning operations.

4. Spinning machine apparatus according to claim 1, wherein means are provided for varying the effect of the auxiliary magnet on the sensor magnet and the magnetic switch after presentation of the auxiliary magnet to a position where it acts to move the sensor magnet to a position away from a yarn passage blocking position.

5. Spinning machine apparatus according to claim 4, wherein the auxiliary magnet is made as an electromagnet to which there is associated a switching device which advantageously controls the excitation in intervals.

6. Spinning machine apparatus according to claim 4, wherein the auxiliary magnet is disposed on a movable presentation device which, after the presentation, can be moved by a drive between two operating positions, advantageously in intervals.

7. Spinning machine apparatus according to claim 1, wherein the auxiliary magnet and its appurtenant control and/or presentation devices are disposed on a mobile servicing device that moves along an open end spinning frame between respective servicing positions adjacent respective spinning units of said spinning frame.

8. Spinning machine apparatus according to claim 2, wherein the auxiliary magnet and its appurtenant control and/or presentation devices are disposed on a mobile servicing device that moves along an open end spinning frame between respective servicing positions adjacent respective spinning units of said spinning frame.

9. Spinning machine apparatus according to claim 4, wherein the auxiliary magnet and its appurtenant control and/or presentation devices are disposed on a mobile servicing device that moves along an open end spinning frame between respective servicing positions adjacent respective spinning units of said spinning frame.

* * * * *